US006298575B1

(12) United States Patent
Aikins et al.

(10) Patent No.: US 6,298,575 B1
(45) Date of Patent: Oct. 9, 2001

(54) PASSIVE SPIN DRYER FOR CONTINUOUS AND BATCH PROCESSING

(76) Inventors: James Edward Aikins, 3305 Tiffany La., Modesto, CA (US) 95350; Warren Ahlson Aikins, P.O. Box 748, Rainier, OR (US) 97048

( * ) Notice: Subject to any disclaimer, the term of this patent is extended or adjusted under 35 U.S.C. 154(b) by 0 days.

(21) Appl. No.: 09/700,644

(22) PCT Filed: Oct. 4, 1999

(86) PCT No.: PCT/US99/23072

§ 371 Date: Nov. 17, 2000

§ 102(e) Date: Nov. 17, 2000

(87) PCT Pub. No.: WO00/20813

PCT Pub. Date: Apr. 13, 2000

(51) Int. Cl.[7] ..... F26B 17/24
(52) U.S. Cl. ..... 34/58; 34/313
(58) Field of Search ..... 34/58, 59, 313, 34/319; 134/159; 99/353

(56) References Cited

U.S. PATENT DOCUMENTS

| | | | | |
|---|---|---|---|---|
| 1,537,625 | | 5/1925 | Skinner . | |
| 2,464,440 | | 3/1949 | Delius . | |
| 3,342,342 | | 9/1967 | Pinkava . | |
| 3,386,180 | | 6/1968 | Balz et al. . | |
| 4,493,156 | | 1/1985 | Siegmann . | |
| 4,809,723 | * | 3/1989 | Meliconi | 134/159 |
| 4,922,625 | * | 5/1990 | Farmer | 34/58 |
| 5,010,805 | * | 4/1991 | Ferrara | 99/353 |
| 5,027,530 | | 7/1991 | Vollmer . | |
| 5,212,876 | | 5/1993 | Berit . | |
| 5,307,567 | | 5/1994 | Schnake . | |
| 5,581,904 | * | 12/1996 | Ewen | 34/319 |
| 5,647,140 | * | 7/1997 | Hudspeth | 34/58 |
| 5,675,905 | * | 10/1997 | Hougham | 34/58 |
| 6,138,375 | * | 1/2000 | Humphries, II et al. | 34/59 |
| 6,170,170 | * | 1/2001 | Van Felius | 34/313 |

FOREIGN PATENT DOCUMENTS

| | | | |
|---|---|---|---|
| 834526 | | 3/1952 | (DE) . |
| 3425955 | * | 2/1985 | (DE) ..... A23N/12/06 |
| 2760602 | | 9/1998 | (FR) . |
| 63-218269 | | 9/1988 | (JP) . |
| WO 97/40714 | | 11/1997 | (WO) . |

* cited by examiner

*Primary Examiner*—Teresa Walberg
*Assistant Examiner*—Leonid Fastovsky

(57) ABSTRACT

A centrifugal dryer (10) has a plurality of conveyors (12) that are arranged inside a pair of trunnion rings (36) such that the conveyors (12) are shingled to form a polygon shaped cylinder (14) that rotates about the central axis (A—A) of the trunnion rings to create centrifugal forces on produce, or other material conveyed on the conveyors. Each conveyor (12) has an elongated endless porous belt (18) driven in one direction by a one-way bearing to convey material from the inlet end to the outlet end of the conveyor. A crank arm (56) extends from each one-way bearing and rides in a gimbal ring (50) which causes reciprocating motion of the crank arm (56) to intermittenly advance the conveyors (12) as they rotate. The gimbal ring (50) can be positionally adjusted to vary the amount each conveyor (12) advances per revolution, or it can be set in a neutral position where no movement is imparted to the crank arms (56), thereby allowing the dryer to process in a batch mode. A conical inlet (58) and outlet (61) are designed to minimized damage to the produce upon entry into and exit from the dryer.

16 Claims, 8 Drawing Sheets

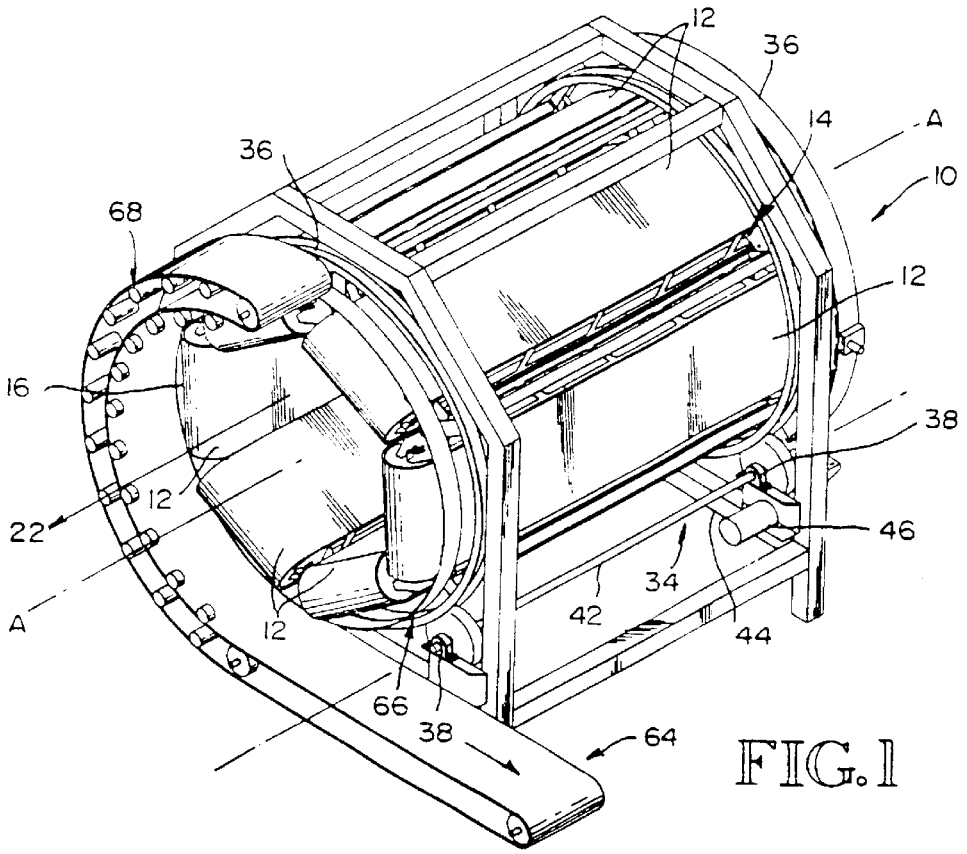
FIG. 1
FIG. 2
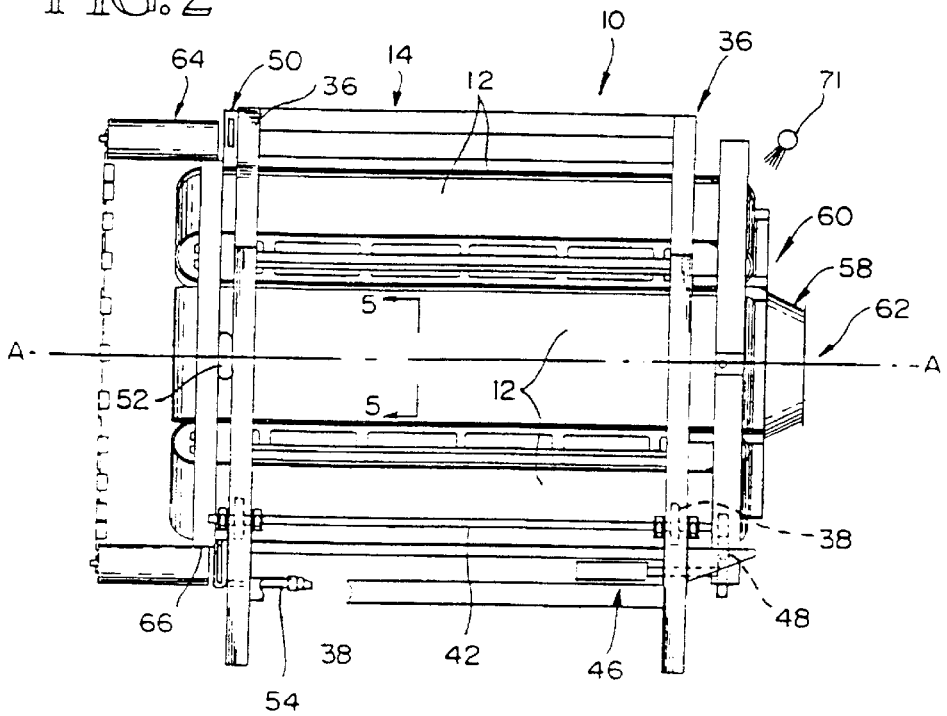

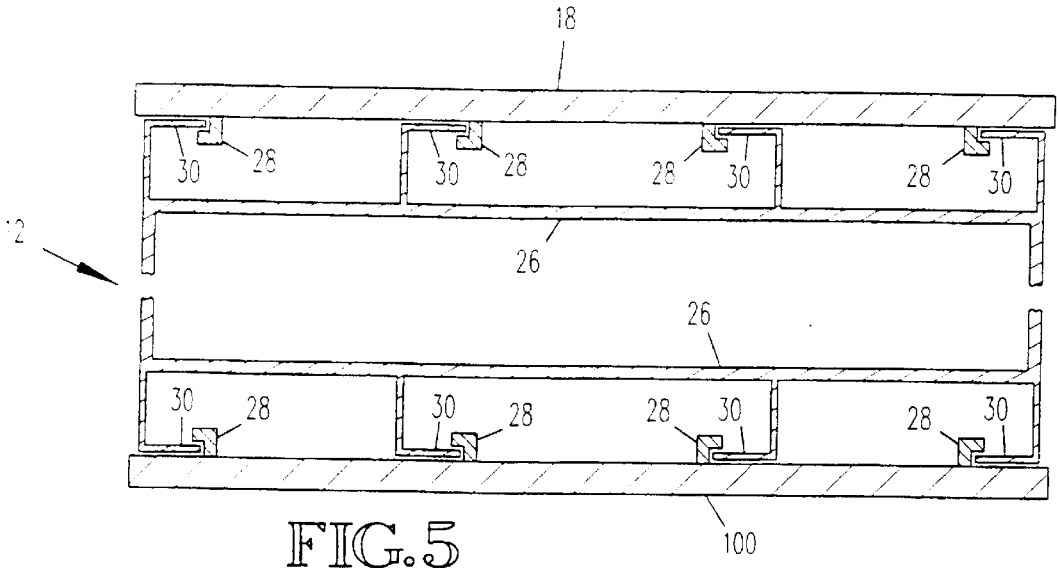
FIG. 5
FIG. 6
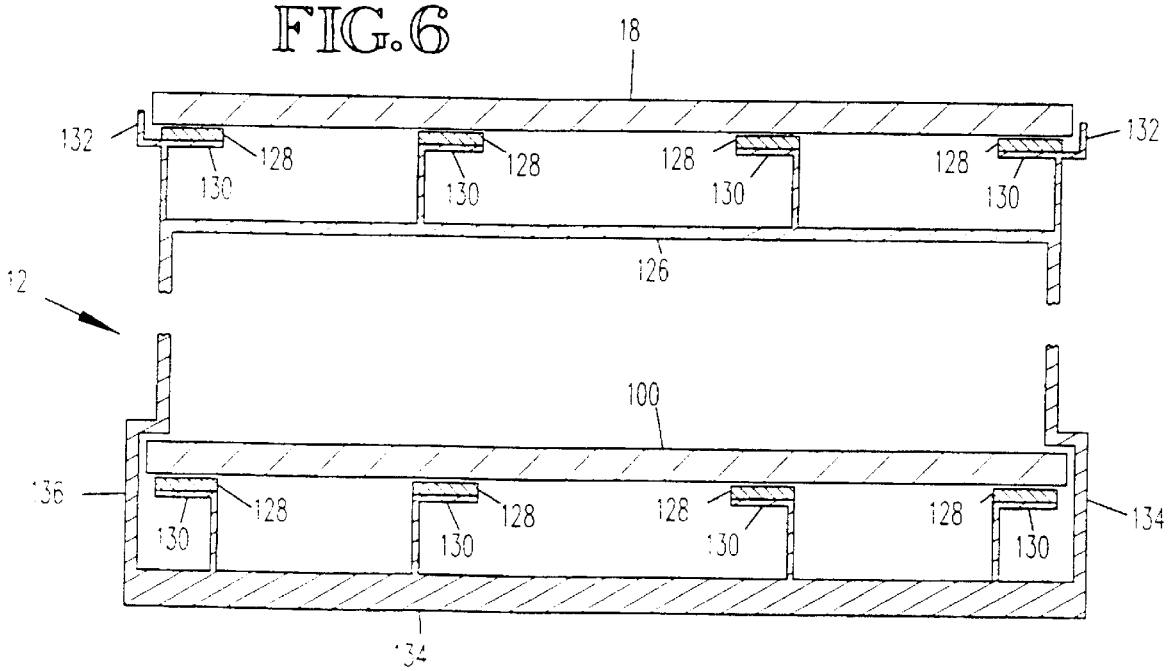

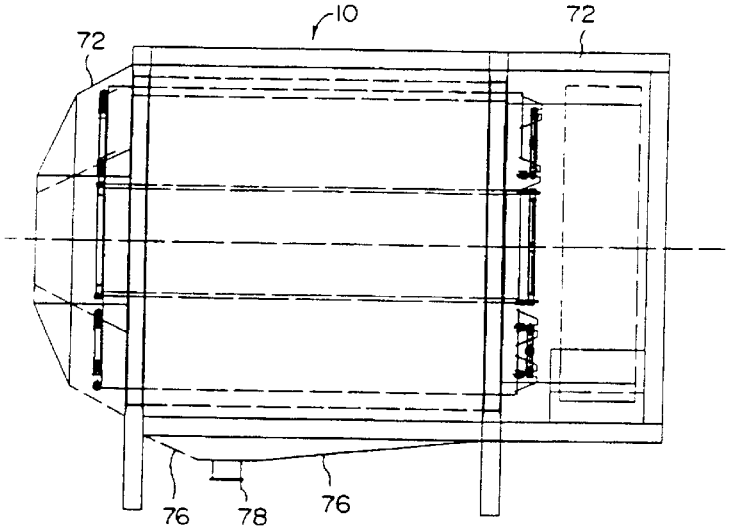
FIG. 11
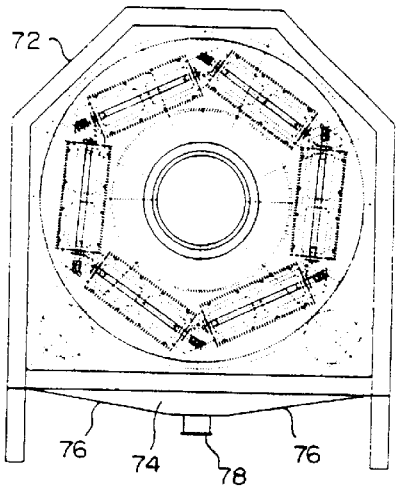
FIG. 12
FIG. 14
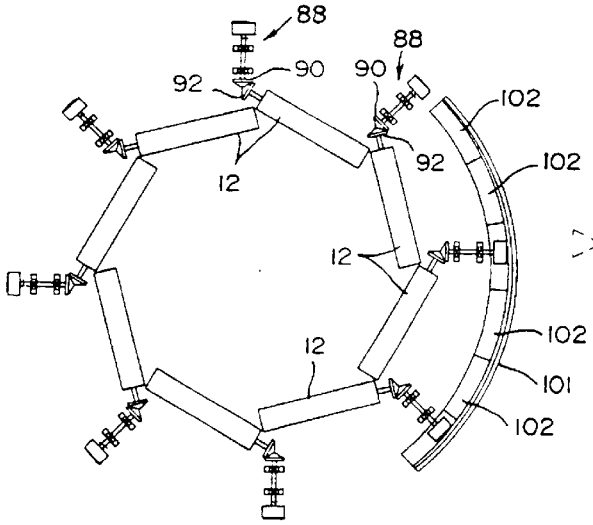
FIG. 15
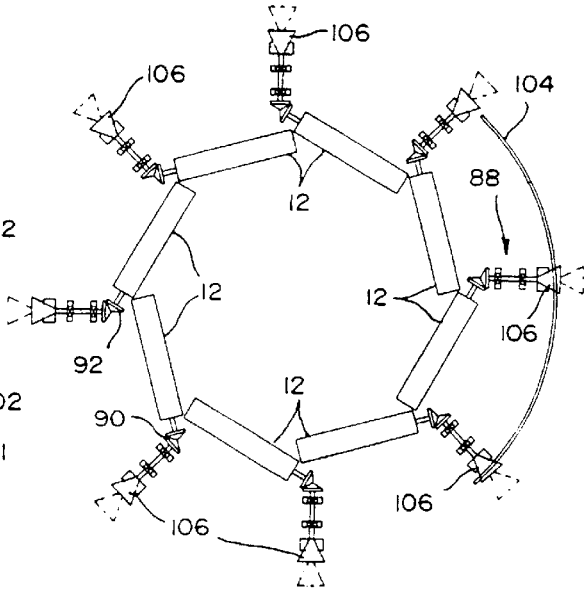

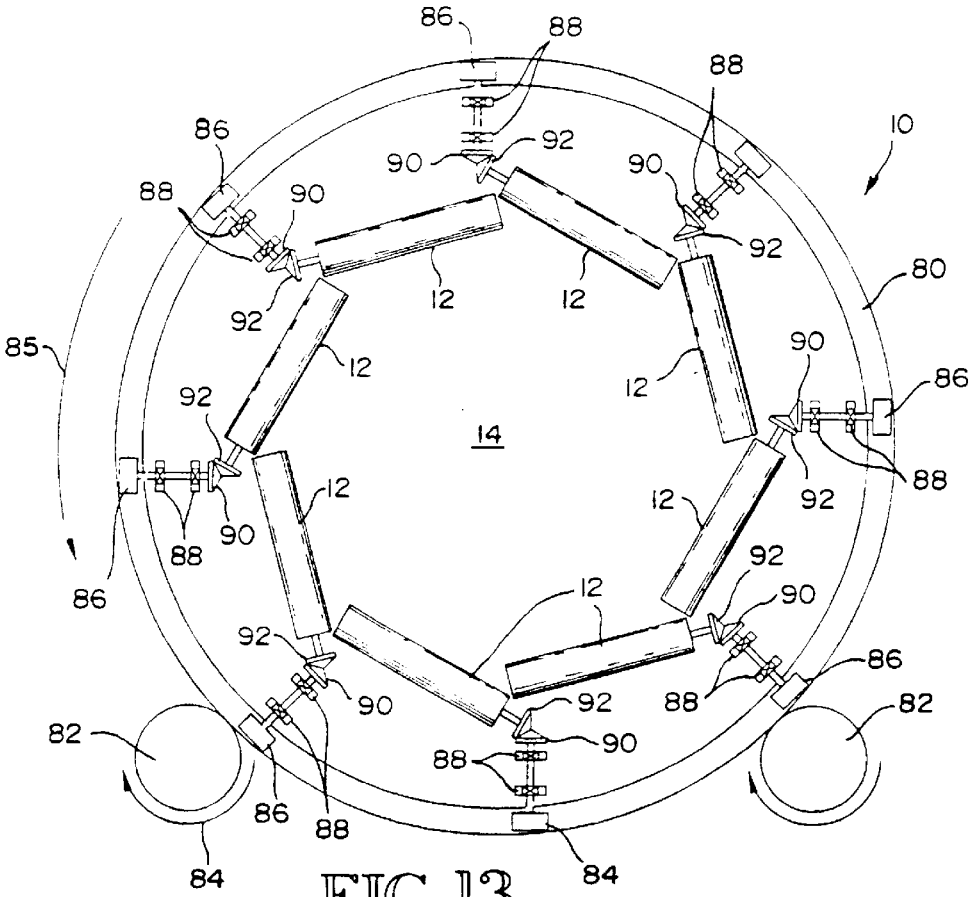
FIG. 13
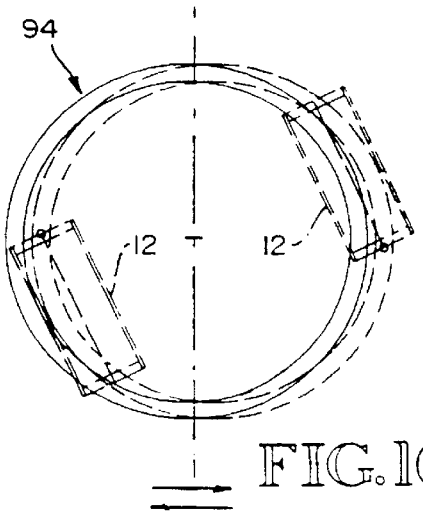
FIG. 16
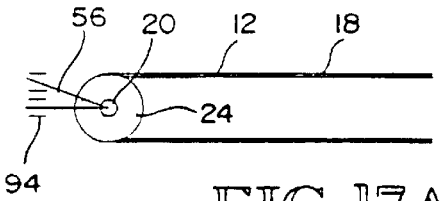
FIG. 17A
FIG. 17B
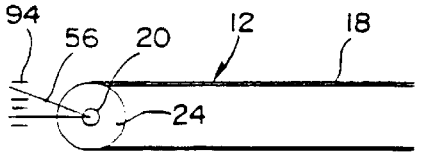

PASSIVE SPIN DRYER FOR CONTINUOUS AND BATCH PROCESSING

BACKGROUND OF THE INVENTION

1 . Field of the Invention

The present invention relates, generally, to an apparatus for drying materials, and is particularly suited for drying of vegetables 2. Background Information Produce, such as vegetables, is typically treated with a chlorine solution prior to packing and shipping for the end market. For leafy vegetables that are often packaged in bags, the vegetables are processed in a slurry form. The bulk of the water can be drained by gravity. However, all excess moisture must be completely removed from the surface of the produce as mold and rot will ensue. Additionally, the produce cannot be damaged during the drying process, as damaged produce either cannot be sold or brings a reduced price. Commercial produce packaging plants, therefore, further "dewater" produce in a commercial dryer.

There are many known commercial dryers using centrifugal force to remove moisture from produce. U.S. Pat. Nos. 4,493,156 to Siegmann and 5,027,5302 Volmer et al. disclose a vertical and horizontal drying apparatus respectively. However, the drying processes of prior art dryers are particularly damaging to produce and much is ruined, with the end result of unacceptable levels of waste. Additionally, existing dryers typically process produce in either a continuous or intermittent (batch) sequence. They do not provide the options for continuous and batch mode of operation in a single dryer. Further, the capacities of these dryers are not sufficient to meet today's demand for high-speed automation, such as processing leafy type vegetables in the range of 2000–7000 pounds per hour.

Applicant's invention provides an improved dryer which overcomes the limitations and shortcomings of the prior art.

BRIEF SUMMARY OF THE INVENTION

The present invention provides a cetrifugal drying apparatus for dewatering produce or removing liquid from other materials. The dryer comprises a plurality of conveyors that are arranged inside a pair of trunion rings such that the conveyors are shingled to form a polygon shaped cylinder that rotates about the central axis of the trunion rings to create centrifugal forces on produce, or other material conveyed on the conveyors. The shingled orientation of the conveyors reduces product spillage and increases yield. A conical inlet and outlet are designed to minimize damage to the produce upon entry into and exit from the dryer. Each conveyor has an elongated endless porous belt driven in one direction by a conveyor drive mechanism to convey material from the inlet end to the outlet end of the conveyor. A control mechanism is connected to the conveyor drive mechanisms to advance conveyors an amount with each revolution of the trunion rings. A drive mechanism is connected to at least one of the trunion rings to rotate the trunion rings and thereby rotate the conveyors about the central axis.

Each conveyor drive mechanism includes a one-way bearing which is actuated in one embodiment by a lever arm extending radially therefrom. The lever arms are received in a portion of a gimbal ring which causes the lever arms to reciprocatingly move an amount with each revolution of the trunion rings. The gimbal ring is positionable about a transverse axis to vary the amount of reciprocating movement, thereby varying the amount the conveyors advance with each revolution. The gimbal ring can also be set in a neutral position where no movement is imparted to the crank arms, thereby allowing the dryer to process in a batch mode.

In another embodiment of pair of slidable concentric rings are substituted for the gimbal ring to achieve the same effect on the lever arms.

In still another embodiment a friction roller is connected to the one-way bearing rather than a lever arm and a friction ring is rotated independently of the conveyors and trunion rings to control the amount the friction rollers turn with each revolution of the the trunion rings. In a variation of this embodiment the friction ring has individual segments which can be selectively actuated to engage or disengage the friction rollers.

In still another embodiment, the friction rollers are cone-shaped and the control mechanism includes a stationary friction drive ring segment positioned adjacent the friction cones to intermittently contact the friction cones as the conveyors and trunion rings rotate. The friction cones are axially adjustable to provide variable circumferential contact with the friction drive ring, thereby controlling the amount each conveyor advances each time its cone contacts the drive ring segment.

The features, benefits and objects of this invention will become clear to those skilled in the art by reference to the following description, claims and drawings.

BRIEF DESCRIPTION OF THE DRAWINGS

FIG. 1 is a perspective view of the dryer drum of the present invention consisting of a plurality of individual endless belt conveyors spaced to form a side-by-side shingled cylindrically-shaped polygonal conveyor assembly and showing an outlet discharge belt.

FIG. 2 is a side view of the conveyor assembly of FIG. 1 and disclosing a conical feed inlet.

FIG. 5 is a cross sectional view of a conveyor belt and its supporting structure taken along line 5—5 in FIG. 2.

FIG. 6 is a cross-sectional view like FIG. 5 of an alternate embodiment of a conveyor belt and its supporting structure.

FIG. 11 is a side view of the dryer drum of FIG. 1 shown mounted within a schroud and with a drip pan beneath the drum.

FIG. 12 is an end view of FIG. 1.

FIG. 13 is a schematic end view of an alternate embodiment of the conveyor assembly disclosing a friction drive ring, mating with individual friction drive wheels, for driving the individual conveyors.

FIG. 14 is a schematic end view of an alternate embodiment of intermittent drive system employing individually actuated ring segments.

FIG. 15 is another alternate embodiment of intermittent drive system employing a spring loaded ring segment that drives an adjustable cone beveled gear assembly, which in turn drives a corresponding conveyor.

FIG. 16 is a schematic end view of an alternate embodiment of the drive mechanism that drives the individual conveyors through a pair of sliding concentric rings.

FIGS. 17A–B are schematic side views of corresponding conveyors with their corresponding one way bearing crank arms moving in rocking motion by action of the slide rings of FIG. 16.

DETAILED DESCRIPTION

Figure 3:
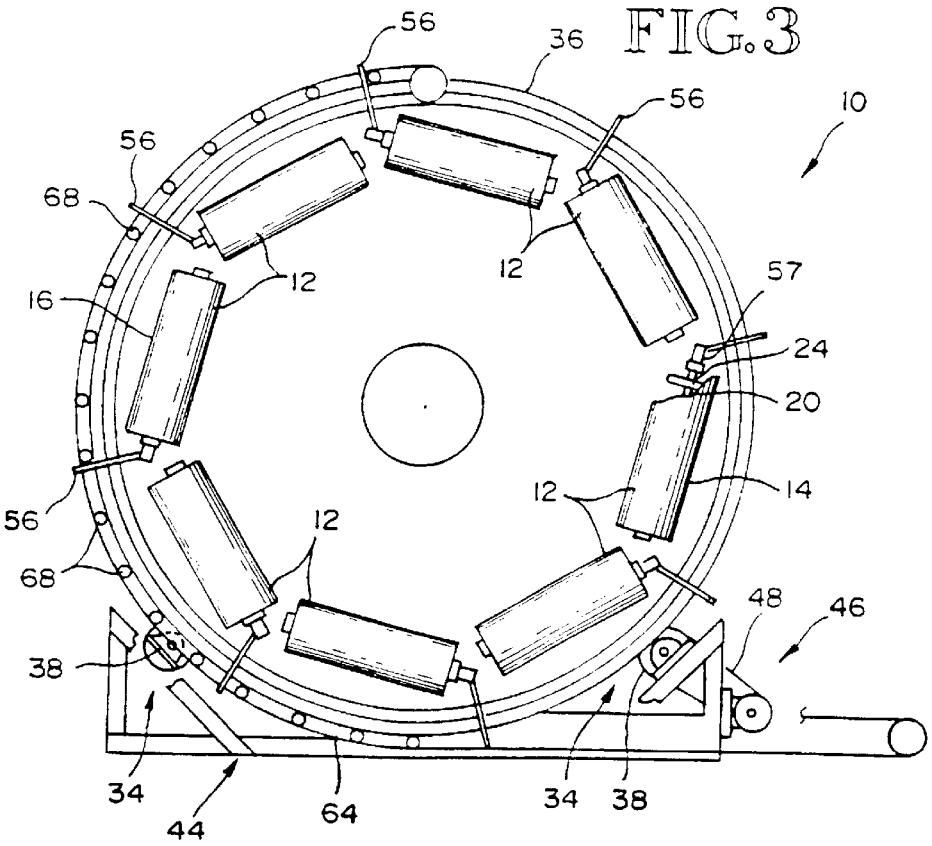
FIG. 3 is an end view of the conveyor assembly and better showing the individual shingled conveyors, a stationary frame supporting the drum, and a trunion drive system to drive the drum relative to the frame.

Referring to FIGS. 1–3, an example of the preferred embodiment of the present invention is illustrated and generally indicated by the reference numeral 10. The dryer is described below first in terms of its major structural elements and then in terms of its secondary structural and/or functional elements which cooperate to perform the drying function.

The present invention is directed to a centrifugal dryer for passive large scale drying or dewatering (the removal of additional water from a product). Although the dryer is most suitable for produce, and particularly for vegetables, the features of the present invention, as further discussed below, make it ideally situated for other products, beyond produce, or as a means for separating different solids from liquids.

Referring to FIGS. 1–3, the present invention is directed to a dryer having a drum 10 which consists primarily of a plurality of shingled individual conveyors 12 forming an essentially cylindrically-shaped polygon conveyor assembly 14 where all the conveyors rotate about an axis A—A, which is the centerline of rotation. In operation, the individual conveyors 12, while rotating about axis A—A, convey product such as produce (not shown) from the inlet end of drum 10 to the outlet end of drum 10, at which point that the dewatered product is discharged from drum 10. Liquids (e.g. water) are separated from the produce (vegetables, etc.) by centrifugal force during operation.

Figure 4:
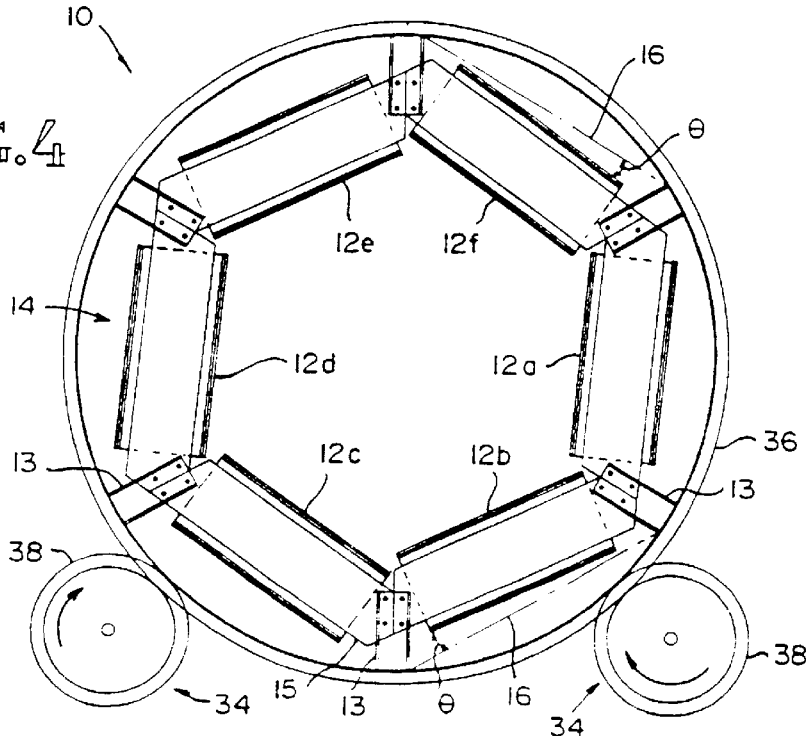
FIG. 4 is an end view of the cylindrically shaped polygon conveyor better showing the structure supporting the conveyors.

Referring particularly to FIG. 4, each conveyor 12 is positioned relative to adjacent conveyors to create a shingling effect such that when the conveyor assembly 14 is rotated in the direction of the arrow, materials on the conveyors 12 can tumble from one conveyor to another without material becoming lodged between conveyors. For example, material on conveyor 12*a* could fall onto conveyor 12*b*, and that on 12*b* could fall onto 12*c*, etc. This shingling feature significantly reduces gaps between the individual conveyors and allows the rotating product to maintain constant contact with the conveyors during rotation, thereby reducing damage to the product (especially fragile produce).

The shingling effect is accomplished by having the plane representing the inner belt surface of one conveyor (12*a*) intersect the surface of the subsequent adjacent conveyor (12*b*). In the preferred embodiment, this is accomplished with belts of uniform circumference being mounted non-tangentially relative to the rotational drive member. Conveyor support members 13 are attached to round channels 36 such that conveyor support members 13 extend radially inward from channels 36 and are uniformly spaced around them. Conveyor mounting plates 15 attach to each end of a conveyor support frame 26 that supports a conveyor 12. The conveyor mounting plates 15 attach between two adjacent conveyor support members 13 such that an angle θ is formed between the conveyor surface and a secant line 16 extending between conveyor support members 13 at round channel 36. For an assembly of six belts as shown, the preferred angle θ is approximately five degrees.

An alternate way of accomplishing the shingling effect would be to use slightly tapered belts that could be mounted tangentially with respect to round channels 36. However, because of the availability of conventional belts having a uniform circumference the above described method of accomplishing the shingling effect is preferred.

Figure 9:
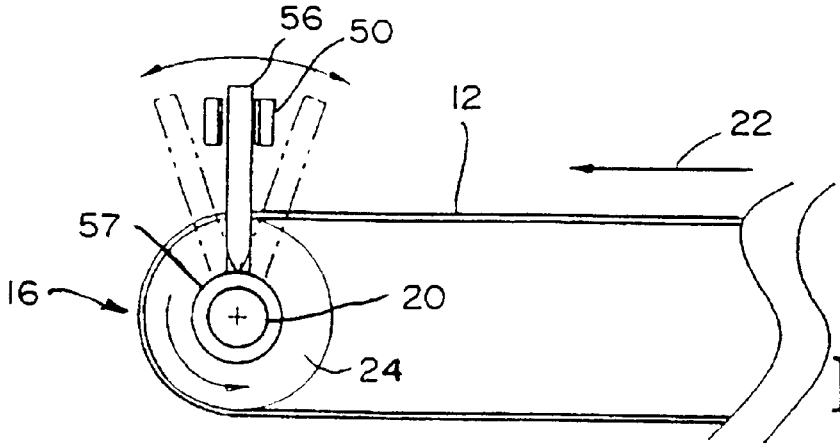
FIG. 9 is an enlarged view of a crank arm on a conveyor capable of moving both back and forth via the gimbal ring but its corresponding conveyor will only move in one direction.

Referring also to FIG. 5, each conveyor 12 includes an endlessly conveyed porous or perforated belt 18. The belt 18 of each conveyor is preferably made of a polymer compound that is food grade approved. The belt 18 is driven by a shaft 20 (FIG. 3), which is driven by a gimbal drive ring that will be discussed in detail below. The belt moves in one direction, which is shown by the arrow 22 (FIGS. 1 and 9). The belt is conveyed in the direction of arrow 22 and returns once the belt has rotated about its end drive wheel 24.

Belt 18 preferably includes a plurality of tabs 28 on its bottom surface near each outer edge and spaced across the belt which cooperate with guide rails 30 attached to conveyor support frame 26 to track the belt during use and to resist centrifugal force pulling the return portion 100 of belt 18 away from the conveyor support frame 26. The guide rails 30 may have a surface made of UHMW plastic where they interface with belt 18. The use of UHMW plastic eliminates the need for lubrication and is ideal for wet environments.

Alternatively belt 18 may not have tabs 28 to constrain the belt during operation. In that case, support frame 126 may have side elements 132 to constrain the belt laterally along with guide rails 130 to support the belt against centrifugal force. To support return portion 100 of belt 18, support frame 126 has outer portion 134 disposed outside of return portion 100 with guide rails 130 extending inwardly therefrom. Outer portion 134 has side elements 136 to laterally constrain the return portion 100. Guide rails 130 may have a friction reducing surface or insert 128 to reduce friction or to act as a wear surface. Insert 128 may be made of any suitable material such as UHMW plastic or TEFLON®.

Referring again to FIGS. 1–4, the polygonal conveyor assembly 14 is driven by a drive system that rotates the conveyor assembly about axis A—A. In a preferred embodiment, a friction trunion roller drive system 34 engages a frame including round channels 36 that contains the polygonal conveyor assembly 14. Round channels 36 are made by known techniques such as rolling straight channels to a round shape, or machining rolled, forged or cast material. Preferably, the frame includes a pair of round channels of a size and shape to engage a pair of trunion wheels 38, which are mounted on a trunion shaft 42. The trunion shaft and trunion wheels are mounted on a stationary frame 44. An electric motor and gearbox 46 may be used to actuate a chain and sprocket drive 48, which in turn drives the trunion wheels 38, which in turn drives the round channels 36 for rotating the conveyor assembly 14 about the drive axis A—A. Alternatively, a chain may positively drive the conveyor assembly or the conveyor assembly may be driven by a combination of both positive engagement and friction elements.

Figure 7:
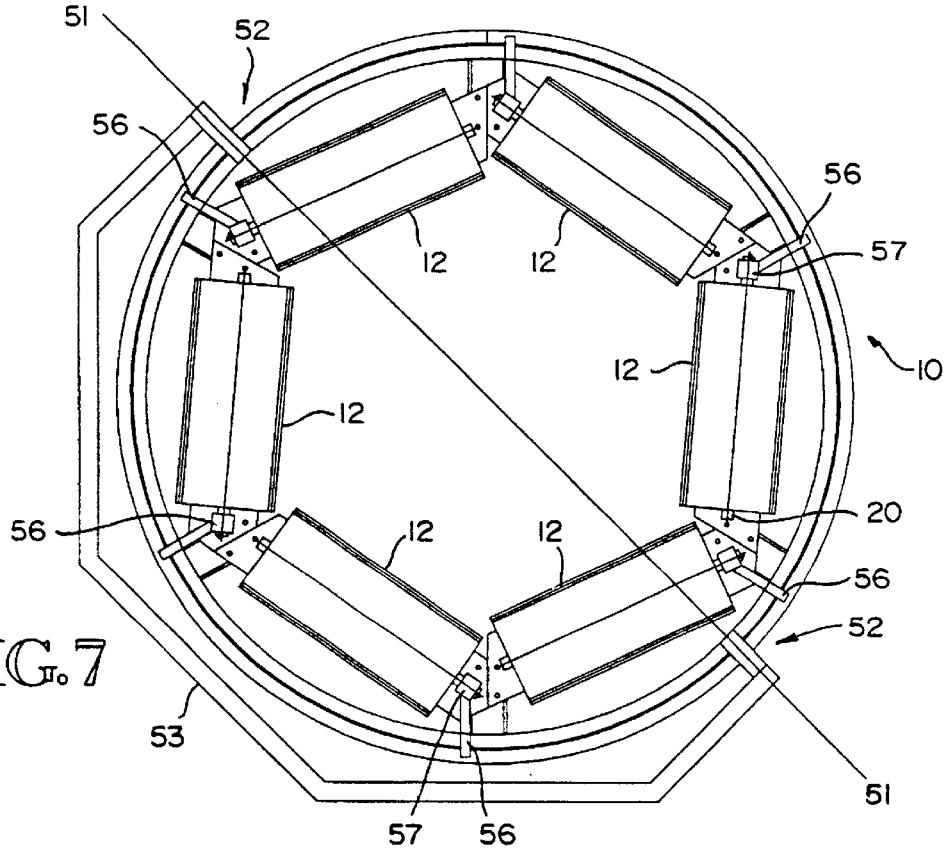
FIG. 7 is a schematic end view of the dryer drum and a gimbal ring used to drive the conveyors in a step-wise manner.
Figure 8:
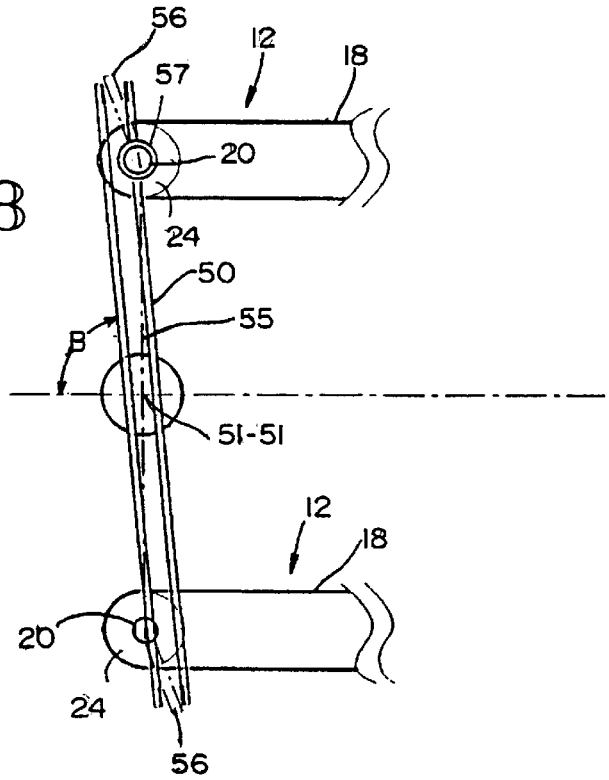
FIG. 8 is a schematic side view of the gimbal ring rotated off vertical to cause a one way bearing crank arm of each conveyor (two arms shown) to move back and forth.

Referring now to FIGS. 7–9, the present invention provides an external gimbal ring 50 mounted for pivotal tilting movement about the axis 51—51 at the pivotal mounting 52 on the gimbal ring frame 53. The gimbal ring may be tilted about the axis 51—51 by a ram 54 (FIG. 2) but is otherwise stationary relative to the rotating conveyor assembly. The ram 54 may be pneumatic, hydraulic, or screw actuated or any suitable alternative equivalent. The gimbal ring, in combination with a one way bearing crank arm 56 located on the end of each conveyor drive shaft provides for step-wise movement of each conveyor belt 18. The gimbal ring 50 rotates off vertical, as shown in angle β in FIG. 8, to cause the one way bearing crank arm 56 to rock back and forth, as indicated in FIG. 9, as the conveyor frame rotates relative to the gimbal ring 50. When the arm 56 is rocked back and forth, a ratcheting effect advances the belt 18 in one direction indicated by arrow 22 in FIG. 9. A one way bearing 57 driven by crank arm 56 functions as a clutch so that the conveyor drive shaft 20 will rotate when the crank arm 56 is moved to the left by the gimbal ring 50 as shown in FIG. 9. When the crank arm is moved to the right toward the vertical and therebeyond, however, the drive shaft 20 will not be rotated. The crank arm 56 is integral to a housing containing the one way bearing 57. One way bearings are well known and may be a shell type roller such as the series HF, HFZ sold by INA Devcon Company. Conveyor shafts 20 are supported by antifriction bearings, preferably made of UHMW plastic. Each driven conveyor shaft 20 is engaged to rotate the end drive wheel 24 of the conveyor 12. The speed of rotation of the drum 10 and tilt position of the gimbal ring determine conveyor speeds. Tilting the gimbal ring changes the length of the processing cycle (i.e. it alters the duration of dwells in the step-wise motion).

One aspect of the invention is the ability to also process the product in an intermittent, or batch method. This is accomplished by positioning the gimbal ring to have a neutral effect, such as by aligning it with the vertical line 55 in FIG. 8. The endless conveyor assembly will rotate but will not be driven to convey any product.

Referring again to FIGS. 1 and 2, the present invention includes an inlet feed and an outlet discharge that is designed to minimize damage to any produce/product. The inlet feed is a conical member 58, seen best in FIG. 2, having a larger opening 60 adjacent the conveyor assembly 14 and a smaller inlet opening 62 at the infeed end. Transfer of product to the inlet opening 62 in the conical member 58 may be accomplished through a conveyor carrying the produce/product with surface moisture, or by a flume, or by being pumped using water as a means of conveyance. If the produce/product is transferred by water, the conical member 58 may include perforations or mesh to allow the water to pass through the mesh and/or perforations and the product to accelerate outwardly onto the conveyor assembly 14. The conical shape of the conical member 58 serves to rotationally accelerate the product/produce before it is transferred to the conveyor assembly 14. The surface speed of the inlet opening 62 is proportionally smaller than the larger opening 60, thereby rotationally accelerating product/produce moving from inlet opening 62 to larger opening 60. Since the rotational speed of the conveyor assembly 14 is approximately that of the product/produce as it leaves larger opening 60 of conical member 58, damage to the product/produce due to its transfer onto the conveyor assembly is greatly reduced.

Figure 10:
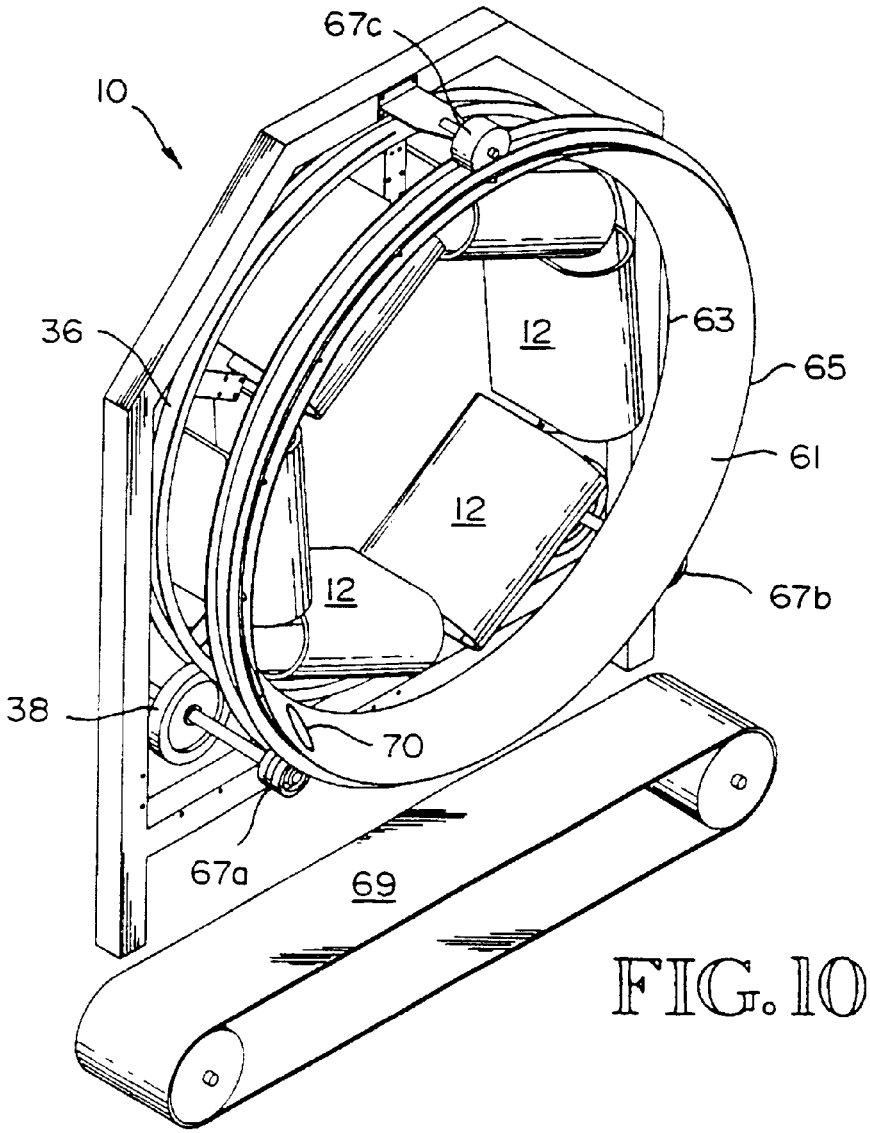
FIG. 10 is a perspective view of the exit portion of the dryer illustrating a conical shaped exit ring and a collection conveyor below it.

Referring to FIGS. 1 and 10, two embodiments for the outlet discharge are illustrated. In FIG. 1 the produce/product is transferred from the conveyor assembly 14 to an endless discharge conveyor belt 64. The discharge conveyor belt 64 need only cover approximately 180 degrees of conveyor assembly 14 because the conveyors 12 are only advancing, and thereby discharging product/produce, during approximately half of their rotation due to the operation of the gimbal ring described above. The discharge conveyor belt 64 is edge-driven by a drive ring 66. The discharge conveyor belt may be supported similar to the belt guide rails described above and shown in FIG. 5 or by idling rollers 68, as shown in FIG. 1. Support for the rollers (or rails—not shown) may be attached and cantilevered to frame 44. The discharge conveyor belt is oriented to allow for static change in the direction of the product/produce. Accumulation of the product/produce is generally accomplished downstream of the dryer in the production cycle to maintain the velocity of the drying processes and to maintain integrity of the product/produce.

The embodiment for the outlet discharge shown in FIG. 10 uses a conical shaped ring 61 supported by rollers 67*a, b* and *c*. The ring 61 has a smaller diameter end 63 adjacent discharge ends of conveyors 12, and a larger diameter end 65. At least one of the rollers 67 is used to drive the ring 61. In this embodiment rollers 67*a* and 67*b* are connected to the same shaft that has trunion wheels 38 used to drive trunion ring 36. Rollers 67*a* and 67*b* are smaller diameter then trunion wheels 38, thereby rotating ring 61 slower than the conveyor assembly 14 rotates. The speed of ring 61 relative to the conveyor assembly 14 is determined by the diameter ratio between rollers 67*a* and *b* and trunion wheels 38. Alternatively, rather than driving ring 61 with rollers connected to the trunion wheels 38, an independent drive source can be used to rotate the ring. For example, roller 67*a* may be connected to a variable speed motor to allow the rotational speed of the ring 61 to be controlled independently of the rotational speed of the conveyor assembly 14.

As product/produce is conveyed from conveyors 12 onto ring 61, the slower rotation of ring 61 and its outward and downward sloping shape direct the product/produce onto a collection conveyor 69 which is disposed below ring 61. Conveyor 69 then conveys the product/produce away for further processing. To further facilitate product/produce being removed from ring 61 and onto conveyor 69, a removal device 70, such as an air knife, may be used to adjacent to ring 61.

Referring to FIG. 2, the conveyor assembly 14 may be cleaned through the addition of a spray bar 71 on either an intermittent or continuous basis. The spray bar's location is shown illustratively, but may be positioned in various locations relative to the conveyor assembly depending on the application. Hygiene may be enhanced and product contamination can be reduced by the introduction of spray systems (or an individual spray bar such as discussed herein) on the infeed end of the conveyor assembly.

Referring to FIGS. 11 and 12, the dryer drum 10 is mounted within a shroud 72. Preferably, the shroud is self-supporting and is anchored to the floor. A drip pan 74 may be attached to the frame, beneath the conveyor assembly. The drip pan 74 collects the excess water during the drying process. Sloping sidewalls 76 of the drip pan funnel any collected water into a well 78 which may include an opening (not shown) for ease in draining the contents of the drip pan. Preferably, the shroud and drum components (less the belt) are made of Nema 4-X stainless steel, required in the food processing industry.

Referring to FIG. 13, a method is schematically illustrated for conveying the product on the conveyor assembly either in a continuous drive with variable speed, or which may be operated to simulate a batch drive system. According to this feature, a friction drive ring 80 is caused to rotate at a speed slightly less than that of conveyor assembly 14. The friction drive ring is rotated by a pair of friction drive ring trunion rollers 82 which rotate in the direction shown by arrows 84. The friction drive ring trunion rollers may be controlled locally or remotely as desired. The friction ring 80, in turn, slowly rotates in a direction shown by arrow 85 in driving contact with a plurality of conveyor drive wheels 86 (one wheel per conveyor 12). Each drive wheel 86 includes a pillow block gear assembly 88, as shown, having a bevel gear 90. Each bevel gear 90 mates with a corresponding bevel gear 92 located on each conveyor 12. Turning the friction drive wheels 86 thus conveys the product (produce and the like) on the conveyors 12. This method creates either a continuous drive with variable speed or may simulate a batch system, depending on the chosen rotational speed of the friction drive ring 80.

FIG. 14 schematically illustrates another conveyor drive system suitable for the present invention to provide intermittent drive to the conveyors 12 . The drive ring 101, similar to drive ring 80 in FIG. 13, may include individually actuated ring segments 102 that are actuated by small pneumatic cylinders or the like. Thus, the conveyors will move intermittently from the individually driven ring segments, as opposed to continuous drive motion from the rotation of a single drive ring.

Another means for accomplishing intermittent processing is shown in FIG. 15, which includes a spring loaded drive ring segment 104 that drives adjustable cones 106 that are part of the pillow block gear assembly 88, discussed above. Here, though, there are no drive wheels. The spring loaded ring segment actuates the adjustable cone 106, which in turn, provides intermittent drive to the bevel gear 90 on the pillow block gear assembly as the drum rotates. The gear 90 in turn, drives its corresponding bevel gear 92 located on each conveyor 12. The ring segment is supported by means (not shown) such that, when different diameters of the drive cones engage it, it can give way and adjust to the diameter. The position of the cones may be manually adjusted along their mounting shafts to obtain different dwell times. This is done while the machine is not operating. The cones may also be mounted to slide on a spline shaft configuration and engage on a slide ring mechanism that would change their radial position, thus changing the diameter of engagement on the drive ring segment 104.

Figure 17C:
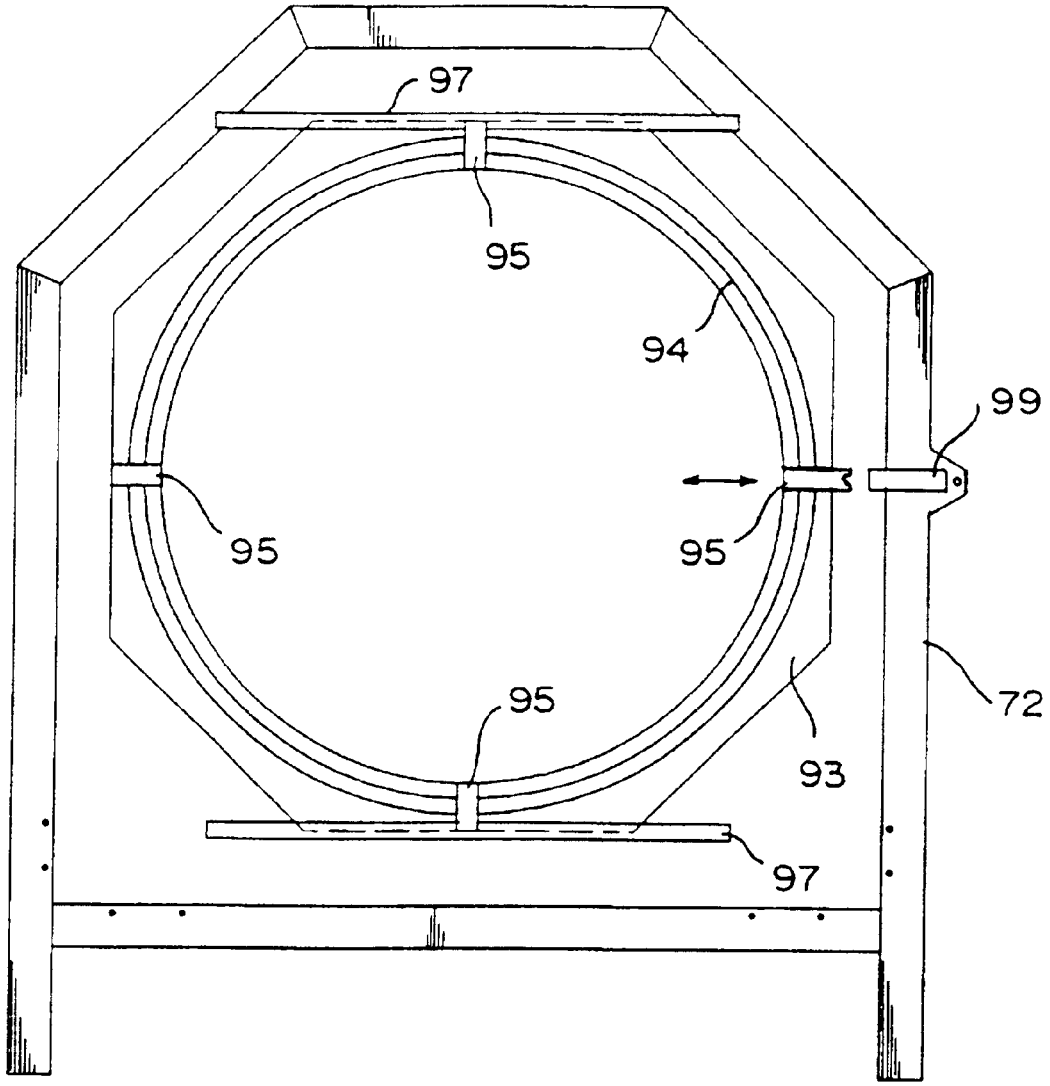
FIG. 17C is a schematic detail illustrating the slide ring mounting and shifting system.

Referring to FIGS. 16 and 17A–C, a pair of of slide concentric rings 94 which remain stationary relative to the rotating drum 10 may be used as an alternate embodiment to the gimbal ring illustrated in FIGS. 7–8, for controlling the movement of conveyors 12. With the gimbal ring configuration crank arms 56 extend approximately radially outward from the conveyor assembly 14. With the concentric rings 94, crank arm's 56 extend approximately axially from the conveyor assembly 14. As the drum 10 rotates, the rocking/swinging motion of the crank arms 56 caused by contact with the slide rings 94 as depicted in FIGS. 17A and 17B, replicates the movement caused by the gimbal ring 50 of FIGS. 7–8 as previously described. As illustrated in FIG. 17C, the rings 94 may be mounted on a frame 93 carried by the shroud frame 72. The brackets 95 serve to connect the inner and outer rings 94 together and to the frame 93. The brackets 95 protrude out of the plane of the page to clear the crank arms 56 which ride between the rings as shown in FIGS. 17A and 17B. The rings to 94 may be coated with UHMW plastic or an equivalent substance as a bearing or anti-friction wear surface. The frame 93 may be mounted in suitable channels 97 constructed from UHMW plastic or equivalent low fricton material and is shifted in the direction shown by the arrows in FIG. 15C by means of a suitable linear actuator 99. The actuator 99 may be a pneumatic, hydraulic, or electrical motor, mechanical screw or any equivalent thereof. The position of the slide rings 94, of course, determine the duration of dwells in the step-wise conveyor movement. One advantage of the shiftable rings 94 is the reduced size and simplified structures. Also, the amplified movement of the conveyor crank arms due to the shingled angle of the rotating conveyors provides better control of the drive means.

The benefits of the present invention are numerous. The uncomplicated system of the present invention provides a high degree of reliability and is hygienic as well. The passive conveyance reduces product defect. The return belt path of the conveyors is designed to be a large diameter to create a higher centrifugal force that will help continuously clean the belt. The shingled orientation of the conveyors reduces product spillage and increases yield. The present invention is designed to handle capacity ranging from 2000–7000 pounds of leafy vegetables an hour. It will also be understood that the rollers or alternate drives may be controlled locally through traditional electro-mechanical controls or through remote programmable logic controllers.

Changing various criteria of the dryer can control the drying process. For example, a dwell time of 87 seconds and produce drying capacity of 3344 lbs./hr can be attained with the following specifications.

| | | |
|---|---|---|
| Centrifugal force calculation: calculate force on product over a One Square foot area using the bulk density, product depth and conveyor RPM. | Weight/area = | 4.8 lbs./sq ft |
| | Force Centrifugal/area = | 5 lbs |
| | Force Aerodynamic = per each conveyor assembly | 1.06 lbs. |

| | Value | Units |
|---|---|---|
| Spin Dryer Calculations | | |
| Parameters to be entered: | | |
| Product bulk density (wet) | 19 | lbs./cubic ft |
| Product depth | 3 | in |
| Conveyor Assy. Spin Dryer RPM | 35 | rev/min |
| Conveyor Drive Sprocket Dia. | 8 | in |
| Conveyor Belt Length | 8 | ft |
| Conveyor Assy. Dia. | 60 | in |
| Conveyor Belt Width | 24 | in |
| Conveyor Quantity | 8 | |
| Gimbal Ring angle | 3 | Deg |
| Drive motor RPM 60 Hz | 1750 | rpm |
| Trunion offset distance | 8 | in |
| Gimbal Ring clearance | 2 | in |
| Trunion drive wheel diameter | 18 | in |
| Trunion drive wheel angle off center | 30 | Deg. |
| Conveyor belt weight per square ft. | 3 | lbs |
| Conveyor rail friction factor | 0.18 | Uf |
| Bearing rolling friction | 0.01 | Uf |
| Coefficient of Drag | 2 | Cd |
| Air Density | 0.0764 | lbm/cubic ft |
| Estimated conveyor assy weight | 130 | lbs |
| Calculated Values: | | |
| Conveyor Assembly Rotational Surface Speed | 550 | ft/Min |
| Conveyor Assembly Rotational Surface Speed | 6.25 | mph |
| Conveyor Drive sprocket rpm | 2.6 | rpm |
| Crank arm length relative to sprocket | 9 | in |

-continued

| | | |
|---|---|---|
| diameter + 5 in | | |
| Crank arm angle | 13.45 | Deg |
| Gimbal Ring Diameter | 80 | in |
| Conveyor Linear Belt Speed | 5.5 | ft/Min |
| Conveyor Belt Surface Area | 128 | sq. ft. |
| Product Weight (Total) in Spin Dryer | 614 | lbs |
| Product Dwell Time | 87 | sec. |
| Capacity | 3344 | lbs./hr |
| Calculate values for Gear Box ratios and HP's | | |
| Trunion diameter for calculating trunion drive wheel speed | 76 | in |
| Trunion drive wheel rpm | 148 | rpm |
| Gearbox ratio (Drive) | 0.08:1 | ratio |
| Weight of conveyor assemblies, belt and product | 2038 | lbs. |
| Horsepower req'd to convey product | 0.25 | HP |
| Horsepower req'd to rotate conveyor assemblies (friction) | 0.5 | HP |
| Horsepower req'd to rotate conveyor assemblies (air resist) | 0.14 | HP |
| Total Horsepower with 80% efficiency | 1.07 | HP |

The descriptions above and the accompanying drawings should be interpreted in the illustrative and not the limited sense. While the invention has been disclosed in connection with the preferred embodiment or embodiments thereof, it should be understood that there may be other embodiments which fall within the scope of the invention as defined by the following claims.

What is claimed is:

1. An apparatus for centrifugally drying materials comprising:

a plurality of elongated conveyors disposed adjacent to each other around a central axis, and generally parallel to the central axis so as to form a polygon, each conveyor having a conveyor drive to advance the conveyor as the conveyors rotate about the central axis, each conveyor drive including a one-way bearing; and a drive mechanism connected to the conveyors outside of the polygon for rotating the conveyors about the central axis.

2. The apparatus of claim 1, wherein the conveyors each have an inner surface relative to the polygon and are shingled relative to one another such that a plane extending from the inner surface of one conveyor intersects the inner surface of an adjacent conveyor.

3. The apparatus of claim 1, further comprising a circumferential shroud disposed outside of the conveyors, the shroud being constructed and arranged to collect liquid removed form the material by the apparatus.

4. The apparatus of claim 1, wherein the conveyors have an inlet end for receiving input material, and further comprising a hollow inlet cone operatively associated with the conveyors, the inlet cone having a larger diameter end adjacent the inlet ends of the conveyors and a smaller diameter end which receives the input material, the inlet cone rotating with the conveyors about the central axis to rotationally accelerate the input material and distribute it to the conveyors.

5. The apparatus of claim 1, wherein the conveyors have an outlet end for discharging dried material, and further comprising an outlet ring operatively associated with the conveyors, the outlet ring having a smaller diameter end adjacent the outlet end of the conveyors and a larger diameter end for delivery of the material, the ring rotating about the central axis independently of the conveyors to rotationally decelerate the dried material discharged from the conveyors.

6. The apparatus of claim 5, further comprising an air knife disposed adjacent to the outlet ring, the air knife providing an air stream operatively associated with the ring to facilitate removing the dried material from the ring.

7. The apparatus of claim 1, wherein the conveyors have an outlet end for discharging dried material, and further comprising:

a drive ring adjacent the outlet end of the conveyors and connected to the conveyors so that the drive ring rotates about the central axis with the conveyors; and a discharge conveyor disposed adjacent to the outlet end of the conveyors, the discharge conveyor being approximately semicircular in shape and having an edge which engages the drive ring such that the discharge conveyor is advanced by the rotating drive ring.

8. The apparatus of claim 1, further comprising a control device for controlling the conveyor drives.

9. The apparatus of claim 8, further comprising a lever arm extending outwardly form the one-way bearing, the lever arm being operatively associated with the control device to rotate the one-way bearing to advance the conveyor.

10. The apparatus of claim 9, wherein the control device includes a gimbal ring having a portion which receives the lever arms of the conveyor drives and which causes the lever arms to reciprocatingly move an amount with each revolution of the conveyors about the central axis, the gimbal ring being positionable about a transverse axis to vary the amount of reciprocating movement.

11. The apparatus of claim 9, wherein the control device includes a pair of concentric rings which receive the lever arms of the conveyor drives therebetween, and which causes the lever arms to reciprocatingly move an amount with each revolution of the conveyors about the central axis, the rings being slidable to vary the amount of reciprocating movement.

12. An apparatus for centrifugally drying materials comprising:

a plurality of elongated conveyors disposed adjacent to each other around a central axis, and generally parallel to the central axis so as to form a polygon, each conveyor having a conveyor drive to advance the conveyor as the conveyors rotate about the central axis, each conveyor drive including a friction roller connected thereto;

a control device for controlling the conveyor drives, the control device including a friction drive ring in contact with the friction rollers, the friction drive ring rotating about the central axis independent of the conveyors to drive the friction rollers; and a drive mechanism connected to the conveyors outside of the polygon for rotating the conveyors about the central axis.

13. The apparatus of claim 12, wherein the friction drive ring further includes individually actuated segments to selectively engage or disengage the friction rollers.

14. An apparatus for centrifugally drying materials comprising:

a plurality of elongated conveyors disposed adjacent to each other around a central axis, and generally parallel to the central axis so as to form a polygon, each conveyor having a conveyor drive to advance the conveyor as the conveyors rotate about the central axis, each conveyor drive including a friction cone connected thereto;

a control device for controlling the conveyor drives, the control device including a stationary friction drive ring segment positioned adjacent the friction cones to intermittently contact and drive the friction cones as the conveyors rotate about the central axis, the friction cones being axially adjustable so as to provide variable circumferential contact with the friction drive ring; and a drive mechanism connected to the conveyors outside of the polygon for rotating the conveyors about the central axis.

15. An apparatus for centrifugally drying materials, comprising:

a trunion ring rotatable about a central axis;

a plurality of adjacent elongated conveyors mounted to the trunion ring inside thereof and generally parallel to the central axis, each conveyor having a conveyor drive to advance the conveyor as the trunion ring and conveyors rotate about the central axis, each conveyor drive including a one-way bearing and a lever arm extending outwardly therefrom, the lever arm moving reciprocatingly with each revolution of the conveyors about the central axis to cause the one-way bearing to advance the conveyor; and a drive device to rotate the trunion ring about the central axis.

16. An apparatus for centrifugally drying materials, comprising:

at least two axially spaced trunion rings rotatable about a central axis;

a plurality of adjacent elongated conveyors extending axially between the trunion rings inside thereof, the conveyors being generally parallel to the central axis so as to form a polygon shape in cross-section inside of the trunion rings, each conveyor having a conveyor drive mechanism for advancing the conveyor, each conveyor drive mechanism including a one-way bearing and a lever arm extending outwardly therefrom;

a control mechanism connected to the conveyor drive mechanisms to advance the conveyors with each revolution of the trunion rings, the control mechanism including a gimbal ring having a portion which receives the lever arms of the conveyor drives and which causes the lever arms to reciprocatingly move an amount with each revolution of the conveyors about the central axis, the gimbal ring being positionable about a transverse axis to vary the amount of reciprocating movement; and a drive mechanism connected to at least one of the trunion rings to rotate the trunion rings with the conveyors about the central axis.

* * * * *